US006264383B1

(12) United States Patent
Kawase

(10) Patent No.: US 6,264,383 B1
(45) Date of Patent: Jul. 24, 2001

(54) IMAGE PRINTING DATA CONTROL METHOD FOR THERMAL TRANSFER PRINTERS

(75) Inventor: Hideo Kawase, Iwate-ken (JP)

(73) Assignee: Alps Electric Co., Tokyo (JP)

( * ) Notice: Subject to any disclaimer, the term of this patent is extended or adjusted under 35 U.S.C. 154(b) by 0 days.

(21) Appl. No.: 09/401,587

(22) Filed: Sep. 22, 1999

(30) Foreign Application Priority Data

Sep. 24, 1998 (JP) ..... 10-269411

(51) Int. Cl.[7] ..... B41J 2/315
(52) U.S. Cl. ..... 400/120.01; 400/120.18
(58) Field of Search ..... 400/120.01, 120.18, 400/120.03, 120.13; 347/212

(56) References Cited

U.S. PATENT DOCUMENTS 5,132,701 * 7/1992 Stephenson et al. ..... 346/1.1
5,494,361 * 2/1996 Sonada ..... 400/120.7
5,512,930 4/1996 Brandt et al. .
5,552,819 9/1996 Brandt et al. .
5,589,869 12/1996 Brandt et al. .

FOREIGN PATENT DOCUMENTS 0 593 303 A2 10/1993 (EP) .
2 286 559 8/1995 (GB) .
09 277 677 10/1997 (JP) .

* cited by examiner

*Primary Examiner*—Ren Yan
*Assistant Examiner*—Darius Cone
(74) *Attorney, Agent, or Firm*—Brinks Hofer Gilson & Lione

(57) ABSTRACT

An object of the invention is to provide an image printing data control method for thermal transfer printers capable of achieving efficient transmission of image printing data from an external control section to a printer control section, and thereby making it possible to reduce the printing time. Image printing data consisting of undercoat printing data for carrying out undercoat printing on recording paper, image data for carrying out desired image printing, and overcoat printing data for carrying out overcoat printing over the image printing are transmitted, at the time of printing, from an external control section to the control section of a thermal transfer printer, wherein the undercoat printing data and the overcoat printing data are common data; each of the undercoat printing step and the overcoat printing step in the printing process is selected as desired; and printing control data indicating the presence or absence of the step of the undercoat printing and the step of the overcoat printing are transmitted, before the transmission of the image printing data, to the control section of the thermal transfer printer.

2 Claims, 2 Drawing Sheets

IMAGE PRINTING DATA CONTROL METHOD FOR THERMAL TRANSFER PRINTERS

BACKGROUND OF THE INVENTION

1. Field of the Invention

The present invention relates to an image printing data control method for thermal transfer printers, and more particularly to an image printing data control method for thermal transfer printers for controlling printing based on various image printing data including undercoat printing data for carrying out undercoat printing on recording paper, image data for carrying out desired image printing, and overcoat printing data for carrying out overcoat printing with transparent ink over said image printing.

2. Description of the Prior Art

In recent years, in order to carry out satisfactory image printing on recording paper, such as ordinary paper and rough paper with relatively uneven surface, printing methods for thermal transfer printers are proposed by which satisfactory printing results are achieved by performing desired image printing with color ink after conducting undercoat printing by the use of an ink ribbon coated with either white ink or transparent ink to smoothen the surface of the recording paper, and further overcoating the printed surface with transparent ink to improve the weatherability or scratch-resistance of the printed surface.

In such a thermal transfer printer, first a ribbon cassette housing an ink ribbon coated with transparent ink or white ink is mounted on the carriage of the printer, and undercoat printing is accomplished on the basis of printing data transmitted from a host side control section such as an external computer or the like.

Image printing based on image data is performed over the surface of the undercoat-printed area using ordinary magenta, cyan blue and yellow color inks, overcoat printing with transparent ink is further applied over this printed image.

In such a printing process, as illustrated in FIG. 3 (Prior Art), undercoat printing data 4 for undercoat printing, image data 5 for image printing and overcoat printing data 6 for overcoat printing are transmitted in a time series from the aforementioned host side control section.

In the above-described printing process of a thermal transfer printer, the quantity of image data to be stored in an external control section or the like can be reduced by having printing data for undercoat printing and overcoat printing as rectangular area information, but printing data for causing a thermal transfer printer to execute printing and printing instructions therefor need to be transmitted in a time series. Accordingly, although the external control section is transmitting the rectangular area information as image printing data, it has to effect printing control over the thermal transfer printer even after the transmission of the image printing data, causing such problems as a low data processing speed, and that the thermal transfer printer has to go through operating cycles to shift to different steps of printing, i.e. from undercoat printing to image printing and then to overcoat printing, as instructed by external host control means, and accordingly takes a long printing time.

SUMMARY OF THE INVENTION

An object of the present invention, therefore, is to provide an image printing data control method for thermal transfer printers which can achieve efficient transmission of image printing data from an external control section to a printer control section, and thereby makes it possible to reduce the printing time.

In order to achieve this object, according to the present invention, there is provided an image printing data control method for thermal transfer printers whereby printing is controlled on the basis of image printing data transmitted from a host side control section to the control section of a thermal transfer printer at the time of printing, the image printing data consisting of undercoat printing data for carrying out undercoat printing on recording paper, image data for carrying out desired image printing, and overcoat printing data for carrying out overcoat printing over the image printing; the undercoat printing data and the overcoat printing data being common data; each of the undercoat printing step and the overcoat printing step being selected as desired; and printing control data indicating the presence or absence of a step of the undercoat printing and a step of the overcoat printing are transmitted, before the transmission of the image printing data, from the host side control section to the control section of the thermal transfer printer.

According to the present invention, the undercoat printing data and overcoat printing data are used as common data and, by transmitting information on the presence or absence of undercoat printing and overcoat printing using this common data as printing control data, it is made possible to select as desired a method by which a desired printing result is obtained by two steps of undercoat printing and image printing, another method by which a desired printing result is obtained by three steps of undercoat printing, image printing, and overcoat printing, still another method by which a desired printing result is obtained by two steps of image printing and overcoat printing, with the undercoat printing dispensed with, and it is further made possible to reduce the time required for recording by improving the processing speed of image printing data while reducing the quantity of image data to be stored in an external control section or the like.

Another feature of the image printing data control method for thermal transfer printers according to the present invention is that, in addition to the above described features of the invention, the undercoat printing data and the overcoat printing data constitute rectangular area data indicating the rectangular area covering the image printing area to be printed at the image printing step.

Further according to the present invention, it is made possible to further lessen the quantity of image data to be stored in the external control section or the like, shorten the time required for transmitting image recording data to the control section of the thermal transfer printer, and accordingly reduce the time required for image printing.

DETAILED DESCRIPTION OF THE PREFERRED EMBODIMENT

Figure 1:
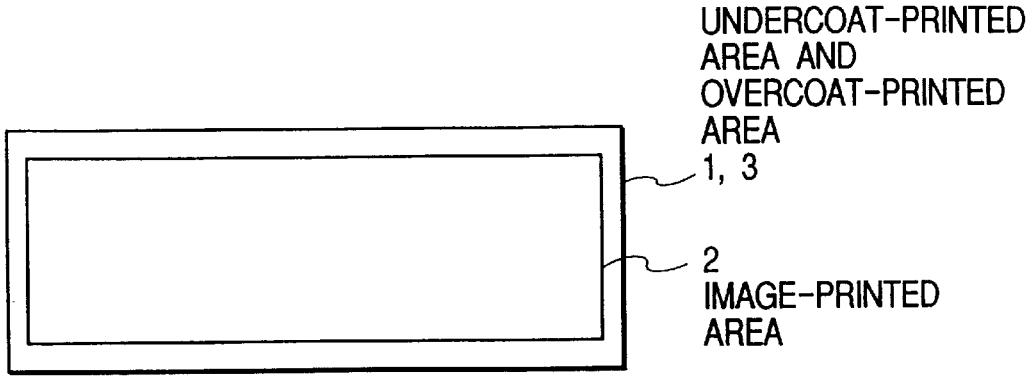
FIG. 1 illustrates how the undercoat printing area and the overcoat printing area relate to the image printing area according to the present invention.
Figure 3:
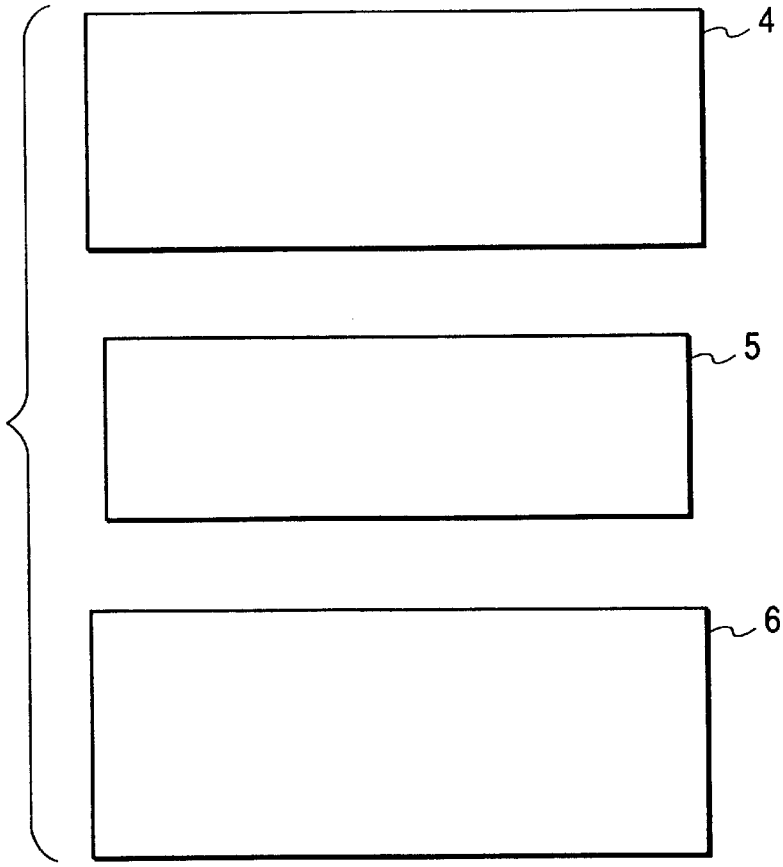
FIG. 3 PRIOR ART
FIG. 3 illustrates bit image data which is printing data according to the prior art.

According to the present invention, printing data on undercoat printing and overcoat printing is supposed to be used in common, and to constitute rectangular area data offering an image printing area to be printed at an image printing step. As illustrated in FIG. 1, they make up rectangular area data of an undercoat printing area 1 and an overcoat printing area 3 for an image printing area 2.

Figure 2:
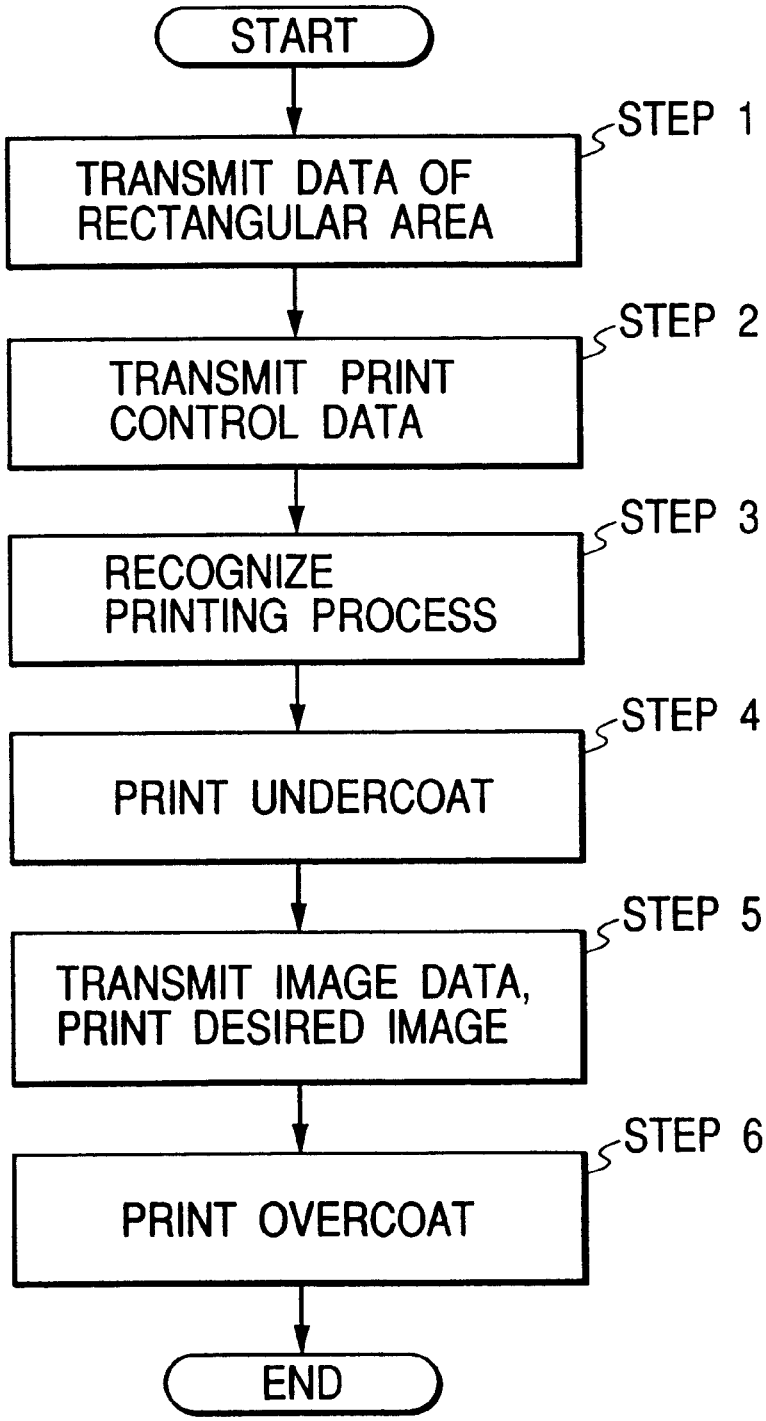
FIG. 2 is a flow chart of printing data control according to the present invention.

Further description will be given below with reference to FIG. 2. When image printing data is to be transmitted from the host side control section to the control section of the thermal transfer printer, this rectangular area data is first transmitted (STEP 1) and, at the same time, printing control data to tell whether this rectangular area data is to be used as undercoat printing data or not and whether it is to be used as overcoat printing data or not (STEP 2).

For instance, where desired image printing is to be carried out using color ink after the surface of recording paper is smoothened by undercoat printing, and the image-printed surface is further to be overcoated with transparent ink, simple printing information to the effect that the rectangular area data will be used as undercoat printing data and overcoat printing data is entered from an external input unit or the like, and this printing information is transmitted as printing control data.

In accordance with this printing control data, the control section of the thermal transfer printer recognizes the printing process that undercoat printing is to be carried out on the basis of the rectangular area data and, after desired image data is printed over that undercoat-printed surface, overcoat printing is to be carried out, again on the basis of the rectangular area data, and stores the rectangular area data as printing data (STEP 3).

In the above-described case, undercoat printing is carried out first in accordance with the rectangular area data that has been transmitted (STEP 4).

Then, desired image printing is performed on the basis of image data that has been transmitted (STEP 5) and, after completion of this image printing, overcoat printing is accomplished in accordance with the printing control data on the basis of the stored rectangular area data (STEP 6).

By transmitting the rectangular area data and the printing control data in advance of the transmission of the image printing data in this manner, the printing process can be advanced without having to wait for printing instructions sent from the host side control section in time series, and accordingly the time required for image printing can be shortened. Furthermore, by storing and using the rectangular area data as common data for the undercoat printing data and the overcoat printing data, the quantity of image printing data to be stored by the control section can be reduced.

Incidentally, the undercoat printing data and the overcoat printing data of the image printing data to be used in common need not be rectangular area data to offer an image printing area as stated above, they may as well be, for example, area data matched to the contour of the image printing area.

Further according to the present invention, it is possible to select as desired a step to perform undercoat printing on recording paper and a step to accomplish overcoat printing over the surface of the recorded image as a protective layer and obtain a desired recorded image.

Thus, in accordance with printing control data from an external input unit or the like as simple printing information, where, for instance, printing information requiring only undercoat printing is entered, the printing control data will be such data as provide for using the aforementioned rectangular area data only as undercoat printing data or where, conversely, printing information dispensing with undercoat printing and requiring only overcoat printing is entered, the printing control data will be data for using the aforementioned rectangular area data only as overcoat printing data. It is further possible to dispense with both undercoat printing and overcoat printing.

The present invention is not restricted to the above described embodiment, but can be modified in various ways as required.

As hitherto described, according to the image printing data control method for thermal transfer printers pertaining to the present invention, by first transmitting from the host side control section undercoat printing data and/or overcoat printing data to be used in common for the aforementioned image printing data and transmitting to the control section of the thermal transfer printer printing control data indicating whether this common data is to be used as undercoat printing data or not and whether it is to be used as overcoat printing or not, overcoat printing after the aforementioned image printing can be carried out automatically without having to wait for an instruction from the external host control section, resulting in a reduced load of printing operation and faster processing by the external host control section. Furthermore, as the thermal transfer printer executes undercoat printing and overcoat printing to suit its own convenience, there is no need for perfect synchronization of its operation, providing a benefit of shortening the time required for printing.

What is claimed is:

1. An image printing method for thermal transfer printers whereby printing is controlled on the basis of image printing data transmitted from a host side control section to a control section of a thermal transfer printer at the time of printing, said image printing including undercoat printing data for carrying out undercoat printing on a recording paper, image data for carrying out desired image printing on the reading paper or on an undercoat, and overcoat printing data being common data for printing in an area covering printing area to be printed on the basis of said image data, said method comprising the steps of:

transmitting said common data and printing control data, said printing control data indicating whether said common data corresponds to the undercoat printing data, the overcoat printing data or both;

determining which one of three printing procedures should be performed on the basis of said printing control data, said determination being made by said control section of said thermal printer, said three procedures being a first printing procedure in which the undercoat printing, the image printing and the overcoat printing are performed in sequence wherein said common data corresponds to both the undercoat printing data and the overcoat printing data, a second printing procedure in which the undercoat printing and the image printing are performed in sequence wherein said common data corresponds to the undercoat printing data, and a third printing procedure in which the image printing and the overcoat printing are performed in sequence wherein said common data corresponds to the overcoat printing data;

transmitting said image data to be printed on said recording paper based on a result of said determining step; and carrying out the undercoat printing, the image printing and/or the overcoat printing in accordance with the printing procedure determined by the control section of said thermal printer.

2. The image printing method of claim 1, wherein:

said undercoat printing data and said overcoat printing data include rectangular area data indicating the rectangular area covering the image data to be printed on said recording paper.

* * * * *

UNITED STATES PATENT AND TRADEMARK OFFICE

CERTIFICATE OF CORRECTION

PATENT NO. : 6,264,383 B1
DATED : July 24, 2001
INVENTOR(S) : Hideo Kawase

It is certified that error appears in the above-identified patent and that said Letters Patent is hereby corrected as shown below:

Title page,
Item [73], Assignee, delete "Co.," and substitute -- Co., Ltd., -- in its place.

Column 4,
Line 5, insert -- data -- before -- "including".
Line 9, insert -- a -- after "covering".

Signed and Sealed this

Sixteenth Day of July, 2002

*Attest:*

*Attesting Officer*

JAMES E. ROGAN
*Director of the United States Patent and Trademark Office*